US005410773A

United States Patent [19]

Forkner

[11] Patent Number: 5,410,773

[45] Date of Patent: May 2, 1995

[54] PIPE PAINT ROLLER

[76] Inventor: Irvine H. Forkner, 120 Old Y Rd., Golden, Colo. 80401-9533

[21] Appl. No.: 226,833

[22] Filed: Apr. 13, 1994

[51] Int. Cl.[6] ..... B05C 17/02

[52] U.S. Cl. ..... 15/230.11; 15/145; 492/30; 492/13

[58] Field of Search ..... 15/230.11, 230.18, 145, 15/143, 230.19, 230.16, 230.18; 492/28, 30, 13, 55, 56

[56] References Cited

U.S. PATENT DOCUMENTS

| | | | |
|---|---|---|---|
| 2,823,402 | 2/1958 | Phillips | 15/230.11 |
| 2,881,461 | 4/1959 | Parker | 15/230.11 |
| 2,929,089 | 3/1960 | Nall | 15/230.11 |
| 3,119,137 | 1/1964 | Schueler | 15/230.11 |
| 3,662,422 | 5/1972 | Christensen et al. | 15/230.11 |
| 3,886,621 | 6/1975 | Welsh | 15/230.11 |
| 4,197,338 | 4/1980 | Perna | 15/230.11 |
| 4,364,143 | 12/1982 | Uhl | 15/145 |
| 4,573,233 | 3/1986 | Stoop | 15/230.11 |
| 4,835,812 | 6/1989 | Su | 15/230.11 |
| 4,930,179 | 6/1990 | Wright et al. | 15/230.11 |
| 5,105,500 | 4/1992 | Bordogna | 15/230.11 |

FOREIGN PATENT DOCUMENTS

| | | | |
|---|---|---|---|
| 454922 | 3/1949 | Canada | 15/230.11 |
| 523766 | 11/1953 | France | 15/230.11 |
| 1053363 | 3/1959 | Germany | 15/230.11 |
| 2001176 | 7/1971 | Germany | 15/230.11 |
| 757659 | 9/1956 | United Kingdom | 15/230.11 |
| 765878 | 1/1957 | United Kingdom | 15/230.11 |

*Primary Examiner*—Timothy F. Simone
*Assistant Examiner*—Gary K. Graham

[57] ABSTRACT

A paint roller structure is arranged to paint in an enclosed manner pipes, parallelepiped picket fence members, wrought iron rods, and the like. The device includes a roller structure having a recess oriented medially of the roller and concentric of the roller to accommodate the workpiece, such as a pipe and the like. Various recess shapes, such as arcuate, square, and rectangular may be provided in accordance with the selected workpiece shape.

1 Claim, 3 Drawing Sheets

PIPE PAINT ROLLER

BACKGROUND OF THE INVENTION

1. Field of the Invention

The field of the invention relates to paint roller apparatus, and more particularly pertains to a new pipe paint roller wherein the same is arranged to accommodate elongated articles for ease of painting of the articles.

2. Description of the Prior Art

Paint roller structure of various types are indicated in the prior art and exemplified by the U.S. Pat. Nos. 5,105,500; 3,562,422; 4,835,812; 4,573,233; and 3,885,521.

The instant invention attempts to overcome deficiencies of the prior art by providing for a paint roller structure arranged for ease of use as well as effectiveness in construction in the coating of an elongated article with a layer of paint and in this respect, the present invention substantially fulfills this need.

SUMMARY OF THE INVENTION

In view of the disadvantages inherent in the known types of paint-roller apparatus now present in the prior art, the present invention provides a pipe paint roller wherein the same is arranged to receive an elongate article within a recess of the roller portion thereof. As such, the general purpose of the present invention, which will be described subsequently in greater detail, is to provide a new pipe paint roller apparatus and method which has many of the advantages of the prior art listed heretofore and many novel features that result in a pipe paint roller apparatus which is not anticipated, rendered obvious, suggested, or even implied by any of the prior art, either alone or in any combination thereof.

To attain this, the present invention provides a paint roller structure is arranged to paint in an enclosed manner pipes, parallelepiped picket fence members, wrought iron rods, and the like. The device includes a roller structure having a recess oriented medially of the roller and concentric of the roller to accommodate the workpiece, such as a pipe and the like. Various recess shapes, such as arcuate, square, and rectangular may be provided in accordance with the selected workpiece shape.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pipe paint roller apparatus and method which has many of the advantages of the prior art listed heretofore and many novel features that result in a pipe paint roller apparatus which is not anticipated, rendered obvious, suggested, or even implied by any of the prior art, either alone or in any combination thereof.

It is another object of the present invention to provide a new pipe paint roller which may be easily and efficiently manufactured and marketed.

A further object of the present invention to provide a new pipe paint roller which is of a durable and reliable construction.

An even further object of the present invention is to provide a new pipe paint roller which is susceptible of a low cost of manufacture with regard to both materials and labor, and which accordingly is then susceptible of low prices of sale to the consuming public, thereby making such pipe paint rollers economically available to the buying public.

Still yet another object of the present invention is to provide a new pipe paint roller which provides in the apparatuses and methods of the prior art some of the advantages thereof, while simultaneously overcoming some of the disadvantages normally associated therewith.

An even further object of the present invention is to provide a new pipe paint roller which is arranged to paint in an enclosed manner pipes, parallelepiped picket fence members, wrought iron rods, and the like.

Still yet another object of the present invention is to provide a new pipe paint roller which includes a roller structure having a recess oriented medially of the roller and concentric of the roller to accommodate the workpiece, such as a pipe and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
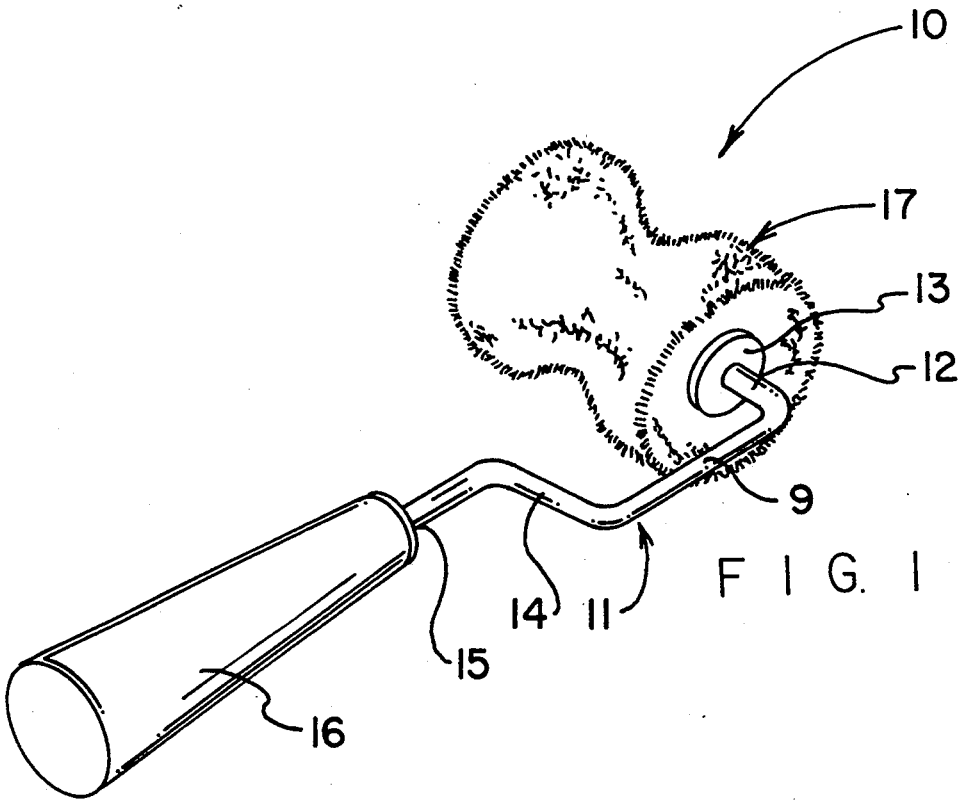
FIG. 1 is an isometric illustration of the invention.

With reference now to the drawings, and in particular to FIGS. 1–5 thereof, a new pipe paint roller embodying the principles and concepts of the present invention and generally designated by the reference numeral 10 will be described.

Figures 3, 4:
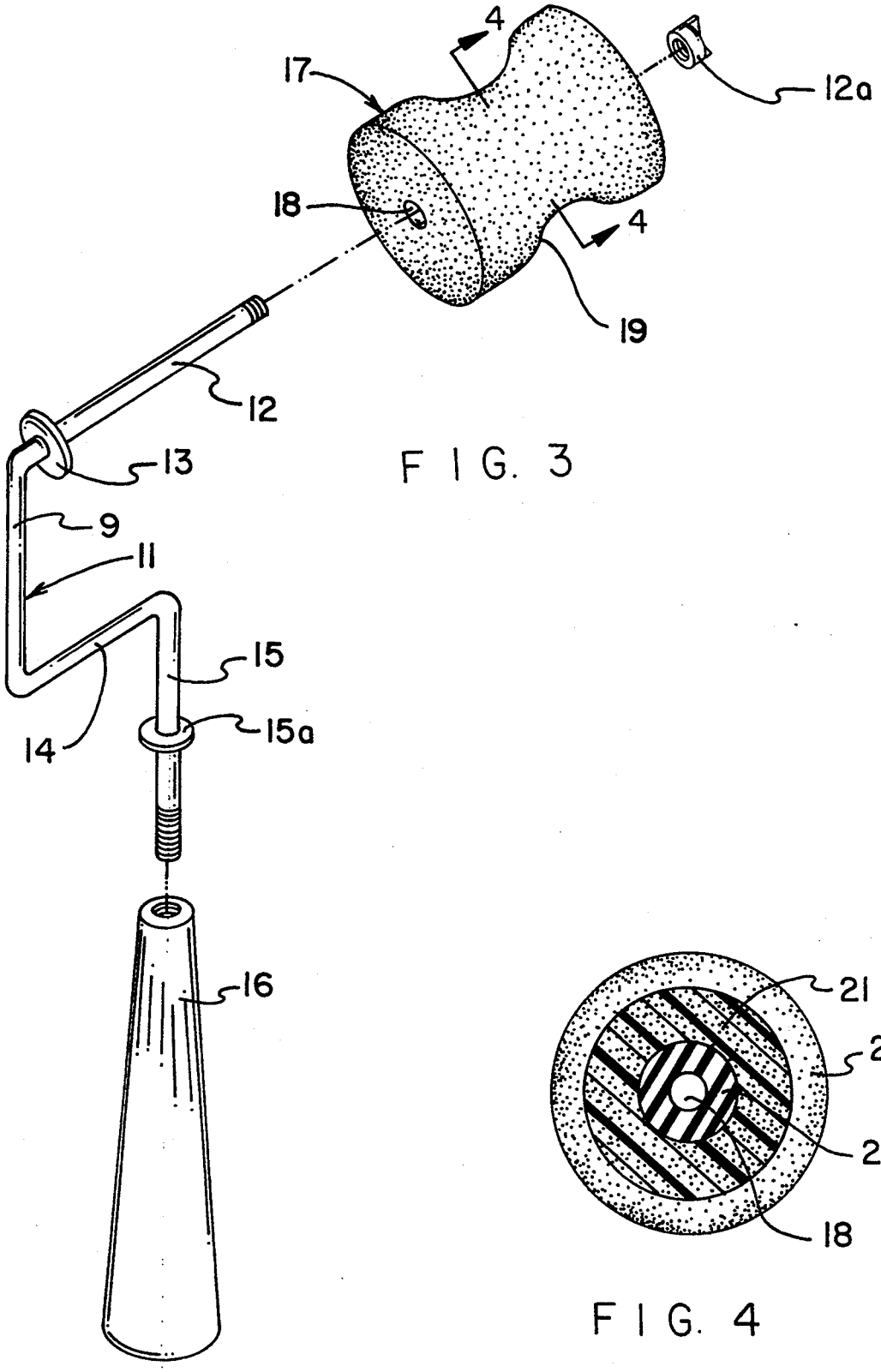
FIG. 3 is an isometric exploded view of the present invention.
FIG. 4 is a cross sectional view, taken along line 4—4 of FIG. 3 in the direction indicated by the arrows.

More specifically, the pipe paint roller 10 of the instant invention comprises a U-shaped support frame 11 having a connecting rod 9 orthogonally mounting a first leg axle 12 upon which a roller member 17 is rotatably mounted. The roller member 17 is rotatably captured between an abutment 13 mounted onto the first leg axle 12 and a fastener 12*a*, as illustrated in FIG. 3. A second leg 14 of the U-shaped support frame 11 is mounted to the connecting rod 9 with and has extending therefrom, at an oblique angular orientation relative thereto, a handle rod 15. A handle 16 is mounted securely to the handle rod 15 and is longitudinally arranged therewith. A handle plate abutment 15*a* engages a top area of the handle 16 to limit a position of the handle along the handle rod 15.

Figure 2:
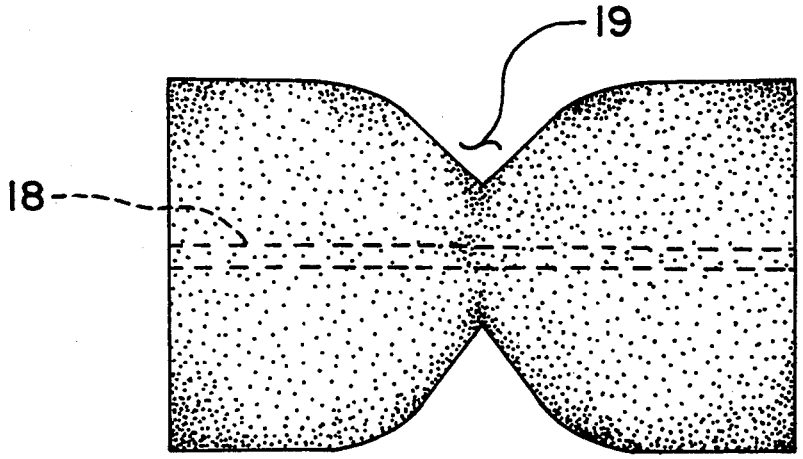
FIG. 2 is a cross sectional view of the roller comprising a portion of the invention.

Referring to FIGS. 2 and 4, it can be shown that the roller member 17 includes a central bore 18 operable to receive the first leg axle 12, with the central bore 18 being directed through a rigid core 22 that has a resilient body 21 directed concentrically and coextensively therewith. The resilient body is operable to accommodate various geometric imperfections in a workpiece, with a resilient or elastic outer cover 20 circumferentially mounted relative to the resilient body 21 permitting ease of cleaning of the organization. In addition, it is contemplated that the cover 20 may be configured so as to be removably fitted to the resilient body 21, thereby permitting ease of cleaning of the organization and/or replacement of the outer cover.

The roller member 17 is shaped so as to define an annular recess 19 proximate a center of a longitudinal length thereof, as best illustrated in FIG. 2. The recess 19 is formed as a reduction in the cross sectional area of the resilient body 21 and such recess may take the form of various shapes, some of which will be subsequently described in more detail. However, to retain rigidity within the construction of the roller, the rigid core 22 should be provided with a constant cross sectional area along its longitudinal length.

Figure 5:
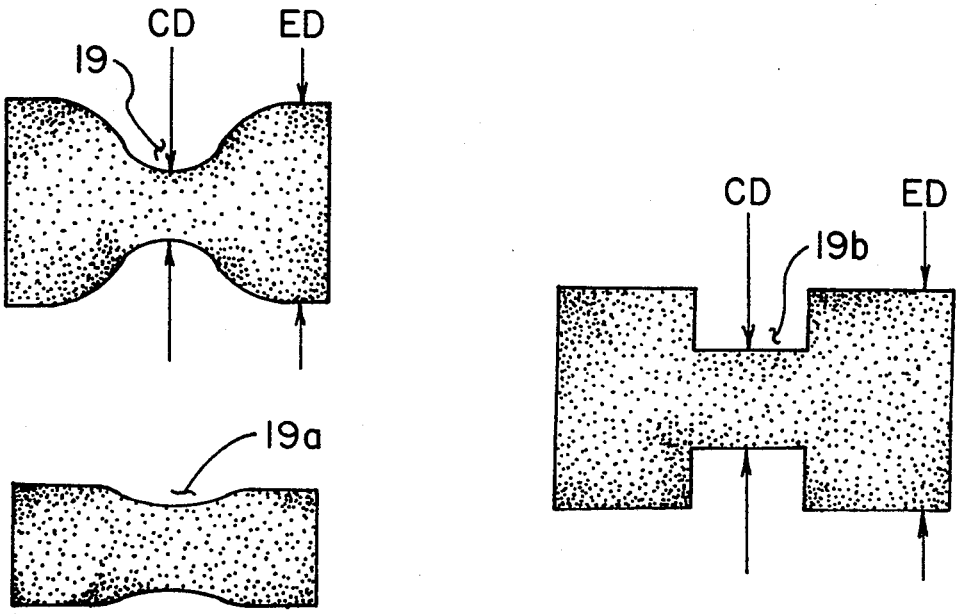
FIG. 5 is an orthographic view of variously configured recesses within the paint roller to accommodate various articles.

FIG. 5 indicates various recess shapes and it can be seen from this figure that the roller member may include construction of the annular recess 19 as pictured in the aforementioned figures, or a shallower recess 19*a*, or a rectangular recess having planar side walls and a cylindrical floor, such as indicated in FIG. 8, to accommodate variously configured workpieces. More specifically, the recess 19 may be utilized with small pipes having a diameter of approximately 1 inch, while the shallower recess facilitates painting of larger diameter pipes, with the rectangular recess permitting the simultaneous coating of both the front and sides of a picket fence member, a wrought iron rod, or the like. Unlike the roller member 17 having the shallow recess 19*a*, it is desirable for roller members 17 having the recess 19 and the rectangular recess 19*b* to have a center diameter CD of approximately one-half that of an end diameter ED such that substantially complete coverage of the workpiece with paint may be accomplished.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pipe paint roller device comprising:

a U-shaped support frame having a connecting rod, the connecting rod having first and second ends, with a first leg axle mounted at the first end of the connecting rod, and a second leg mounted to the second end of the connecting rod, the first leg axle having a first leg axle abutment mounted to the first leg axle, the second leg having a handle rod extending obliquely relative to the second leg, and a handle member removably mounted to the handle rod, with a handle abutment mounted to the handle rod and positioned into engagement with the handle; and, a roller member rotatably mounted to the first leg axle and positioned in rotatable engagement with the first leg axle abutment, the roller member having a central core, with the central core including an elongated bore, with the elongate bore receiving the first leg axle therethrough, and a resilient body surrounding the central core and attached thereto, with a flexible elastic outer cover circumferentially and removably mounted to the resilient body, the outer cover and the resilient body being substantially cylindrical in shape and having an annular recess oriented medially of the roller member and concentrically relative to the bore, said annular recess being substantially rectangular in shape so as to define a center cylindrical floor surface and a pair of planar vertical side wall surfaces extending orthogonally upward from said center cylindrical floor surface, said annular recess being spaced a predetermined distance from respectively opposed ends of the roller member such that said annular recess is flanked on both sides of said annular recess by cylindrical surfaces covered by said flexible outer cover, whereby said cylindrical surfaces, said planar vertical side wall surfaces, and said center cylindrical floor surface can be simultaneously engaged to a workpiece.

* * * * *